US006828578B2

(12) United States Patent
DeMeo et al.

(10) Patent No.: US 6,828,578 B2
(45) Date of Patent: Dec. 7, 2004

(54) LIGHTWEIGHT RADIATION PROTECTIVE ARTICLES AND METHODS FOR MAKING THEM

(75) Inventors: Ronald DeMeo, Miami, FL (US); Joseph Kucherovsky, Philadelphia, PA (US)

(73) Assignee: Meridian Research and Development, Ft. Lauderdale, FL (US)

( * ) Notice: Subject to any disclaimer, the term of this patent is extended or adjusted under 35 U.S.C. 154(b) by 0 days.

(21) Appl. No.: 10/238,160

(22) Filed: Sep. 9, 2002

(65) Prior Publication Data

US 2003/0010939 A1 Jan. 16, 2003

Related U.S. Application Data

(63) Continuation-in-part of application No. 09/940,681, filed on Aug. 27, 2001, which is a continuation-in-part of application No. 09/206,671, filed on Dec. 7, 1998, now Pat. No. 6,281,515.

(51) Int. Cl.[7] ..... G21F 3/02
(52) U.S. Cl. ..... 250/519.1; 250/516.1
(58) Field of Search ..... 250/516.1, 519.1; 252/582; 600/8; 523/136

(56) References Cited

U.S. PATENT DOCUMENTS

| | | | | |
|---|---|---|---|---|
| 1,800,051 | A | | 4/1931 | Bianco |
| 3,030,628 | A | | 4/1962 | Crosson |
| 3,045,121 | A | | 7/1962 | Leguillon |
| 3,052,799 | A | | 9/1962 | Hollands |
| 3,164,840 | A | | 1/1965 | Reynolds |
| 3,569,713 | A | | 3/1971 | Via, Jr. |
| 3,883,749 | A | | 5/1975 | Whittaker et al. |
| 3,974,104 | A | | 8/1976 | Foster et al. |
| 4,103,176 | A | | 7/1978 | Coyle |
| 4,129,524 | A | | 12/1978 | Nagai et al. |
| 4,429,094 | A | | 1/1984 | Massucco |
| 4,589,408 | A | | 5/1986 | Singer |
| 4,740,526 | A | | 4/1988 | Yamamoto |
| 4,882,392 | A | | 11/1989 | Smid et al. |
| 4,913,978 | A | | 4/1990 | Klotz et al. |
| 4,938,233 | A | * | 7/1990 | Orrison, Jr. ..... 128/849 |
| 5,001,354 | A | | 3/1991 | Gould et al. |

(List continued on next page.)

OTHER PUBLICATIONS

SU 1424847A Gorelashvi, G.P.; Kuus E.M.; Talvari, A.A.

*Primary Examiner*—John R. Lee
*Assistant Examiner*—Johnnie L Smith, II
(74) *Attorney, Agent, or Firm*—Townsend and Townsend and Crew LLP; Guy W. Chambers

(57) ABSTRACT

An article which has radiopaque qualities and a method for making it. In a preferred embodiment, a lightweight fabric, such as a cloth surgical mask liner (24) or an entire surgical mask (10), is impregnated with a relatively lightweight radiopaque material, such as a barium sulfate compound, to impart radiopaque qualities. In other embodiments, a similar fabric is used to produce an entire radiation protective jumpsuit, a tent, wallpaper or a liner for a commercial aircraft cabin. Impregnation of the relatively lightweight radiopaque material can be performed in a number of ways, including soaking the fabric in a solution containing the relatively lightweight radiopaque material or using the fabric as a filter in a passing solution of the lightweight radiopaque material. In one preferred embodiment, which is particularly suited for mass production of relatively lightweight radiopaque fabrics, a lightweight radiopaque material is mixed with a liquid polymer. The polymeric mixture is then laminated onto one or more layers of the fabric and perforated, as needed, to produce a plasticized form of lightweight radiopaque fabric. Alternatively, the polymeric mixture can be formed into a free standing film.

87 Claims, 8 Drawing Sheets

U.S. PATENT DOCUMENTS 5,016,292 A 5/1991 Rademacher
5,038,047 A 8/1991 Still
5,059,807 A * 10/1991 Kersten et al. ..... 250/519.1
5,140,710 A 8/1992 Rademacher
5,245,195 A 9/1993 Shah et al.
5,446,925 A 9/1995 Baker et al.
5,453,314 A * 9/1995 Collier et al. ..... 428/198
5,506,059 A 4/1996 Robbins
5,523,581 A 6/1996 Cadwalader et al.
5,525,408 A 6/1996 Weir et al.
5,548,125 A * 8/1996 Sandbank ..... 250/519.1
5,604,784 A * 2/1997 Widlicka et al. ..... 378/203
5,637,113 A 6/1997 Tartaglia et al.
5,660,892 A 8/1997 Robbins et al.
5,778,888 A * 7/1998 Sheehy ..... 128/846
5,856,415 A 1/1999 Lagace et al.
6,153,666 A * 11/2000 Lagace ..... 523/136
6,281,515 B1 8/2001 Demeo et al.
6,310,355 B1 * 10/2001 Cadwalader ..... 250/515.1
6,459,091 B1 10/2002 DeMeo et al.
6,548,570 B1 * 4/2003 Lange ..... 523/137
6,599,448 B1 * 7/2003 Ehrhard et al. ..... 252/582
6,665,877 B1 * 12/2003 Gray ..... 2/69
6,674,087 B2 * 1/2004 Cadwalader et al. ..... 250/515.1

* cited by examiner

LIGHTWEIGHT RADIATION PROTECTIVE ARTICLES AND METHODS FOR MAKING THEM

CROSS-REFERENCES TO RELATED APPLICATIONS

This application is a continuation-in-part of application Ser. No. 09/940,681, filed Aug. 27, 2001, which was itself a continuation-in-part of application Ser. No. 09/206,671, filed Dec. 7, 1998, entitled "Lightweight Radiation Protective Garments," which is now U.S. Pat. No. 6,281,515, issued Aug. 28, 2001.

FIELD OF THE INVENTION

The present invention relates primarily to articles, including fabrics, compounds and film layers, that can protect against the hazards of exposure to radiation. In some embodiments, the fabrics and films of the present invention are used to produce relatively lightweight garments containing radiopaque materials, such as barium, bismuth, tungsten and their compounds, that are particularly suitable to protect those who are exposed to radiation (e.g., medical workers who are exposed to radiation from medical x-rays, nuclear power plant workers, soldiers etc.). Moreover, the radiopaque materials of the present invention can be incorporated into a wide variety of structures, including drywall, airplane surfaces and house sidings. The radiopaque materials of the present invention can further be formulated into paints or other coatings to impart radiation protection to a wide variety of different surfaces.

BACKGROUND OF THE INVENTION

It is very common in medicine today to use x-rays for diagnostic and therapeutic purposes. While these x-rays serve a beneficial medical purpose, they can also have harmful side effects for both the patient to whom the x-rays are directed and the medical workers who must administer x-rays on a day-to-day basis.

Other examples of how people are exposed to the harmful effects of radiation in their everyday work include the high atmosphere solar radiation which bombards commercial airliners, the radon which seeps into houses and, of course, the radiation present at nuclear power plants. In many cases, people may be exposed to health threatening doses of radiation without even realizing it.

Further, in the aftermath of the Sep. 11, 2001 terrorist attacks on the World Trade Center and the U.S. Pentagon, there has been renewed concern about the damage that could be caused by a terrorist nuclear bomb, such as a "dirty bomb" incorporating nuclear waste material. While the actual destruction caused by such a "dirty bomb" might be minor, the hazards of having radioactive material widely dispersed around an unprotected population center could be immense. If only for peace of mind, there is a great need to provide protection against such a catastrophic possibility.

There have been a number of previous attempts to mitigate the harmful effects of x-rays through the design of radiopaque protective garments. Typically, these radiopaque garments consist of a stiff material, such as rubber, impregnated by lead or some other heavy metal which is capable of blocking x-rays. Examples of lead impregnated radiopaque garments can be found in Holland's U.S. Pat. No. 3,052,799, Whittaker's U.S. Pat. No. 3,883,749, Leguillon's U.S. Pat. No. 3,045,121, Via's U.S. Pat. No. 3,569,713 and Still's U.S. Pat. No. 5,038,047.

While the lead filled prior art garments provide a good measure of protection against the harmful effects of x-rays, these prior art garments are often heavy, stiff, expensive, bulky and lacking in breathability. As such, these garments are often uncomfortable, cumbersome and restrictive. Moreover, lead, of course, is a toxic substance which must be handled very carefully and cannot be carelessly disposed of. Also, there are sterility issues with these prior art garments because they are typically too bulky and expensive to dispose of after each use. In view of lead's heavy weight, the inventors are unaware of any lead garments that protect every part of the human body.

BRIEF SUMMARY OF THE INVENTION

The present invention provides a way to incorporate relatively lightweight radiopaque materials into many sorts of articles. In one preferred embodiment, a lightweight fabric, such as a cloth surgical mask liner or an entire surgical mask, is impregnated with a relatively lightweight radiopaque material, such as barium, bismuth, tungsten and their compounds, to impart radiopaque qualities. Examples of suitable barium, bismuth and tungsten compounds include barium sulfate, barium chloride, tungsten oxide and tungsten carbide. While these radiopaque materials may not be "lightweight" in absolute terms, they are certainly "lightweight" in relation to the radiopaque lead compounds which are used in the prior art. In other embodiments, a similar lightweight radiation protective fabric is used to produce an entire radiation protective jumpsuit, a tent, wallpaper, a liner for a commercial aircraft cabin or house sidings. Further, the radiopaque materials of the present invention can be incorporated into a paint or coating and applied to a wide variety of surfaces to thereby impart radiopaque qualities to those surfaces.

Impregnation of relatively lightweight radiopaque materials into articles can be performed in a number of ways. In one preferred embodiment, which is particularly suited for mass production, a relatively lightweight radiopaque material, such as barium, bismuth, tungsten or their compounds, is mixed with a liquid solution, emulsion or suspension of a polymer in solvent or water. The polymeric mixture is then used as a laminating adhesive or coating for one or more layers of fabric and perforated, as needed, to produce a plasticized form of lightweight radiopaque fabric. In other preferred embodiments, (1) a woven or unwoven fabric is soaked or dipped in a solution containing the relatively lightweight radiopaque material, (2) the fabric is used as a filter for a passing solution containing the relatively lightweight radiopaque material, (3) the fabric is placed in a reaction chamber between reagents that can react to form the relatively lightweight radiopaque material and (4) the fabric is created to incorporate one radiopaque chemical reagent and then exposed it to a complementary reagent to form the radiopaque material. To improve the efficiency of impregnation, an adhesive, such as Gum Arabic or Guar Gum, can be added to either the fabric or the solution of relatively lightweight radiopaque material during the impregnation process.

Besides barium, bismuth, tungsten and their compounds, other relatively lightweight radiopaque materials can be used for the present invention. These other lightweight radiopaque materials include, but are not limited to, HYPAQUETM (which is a tradename of Nycomed Corporation for Diatrizoate Meglumine Inj USP), Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

In alternative embodiments, radiopaque qualities can be imparted to garments by using a light sheet of radiopaque liner, such as aluminum, or weaving radiopaque metal or radiopaque threads into the garment. While a surgical mask is provided as one example, the principles of the invention can also be applied to a broad range of other articles including surgical hoods, hospital gowns, gloves, patient drapes, partitions, coverings, jumpsuits, uniforms, fatigues, tents, envelopes, pouches, wallpaper, liners, drywall, house sidings etc. In addition, transparent items with radiopaque qualities, such as an impregnated eye shield, can be attached to or incorporated within the radiopaque garments of the present invention.

DETAILED DESCRIPTION OF THE INVENTION

Figure 1:
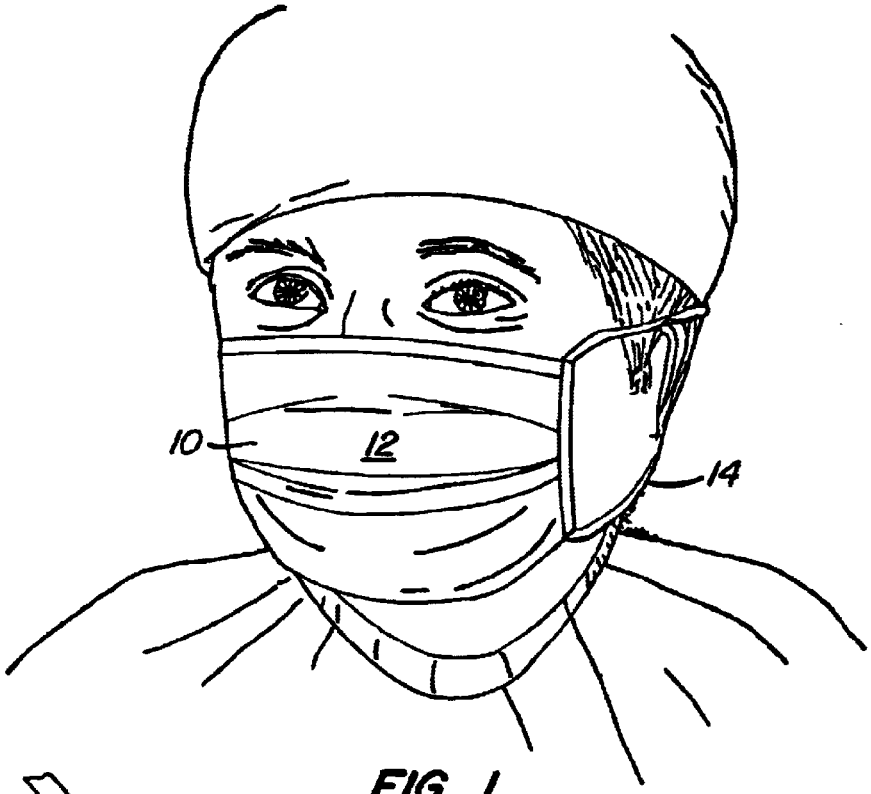
FIG. 1 shows a doctor wearing a surgical mask of the present invention.
Figure 2:
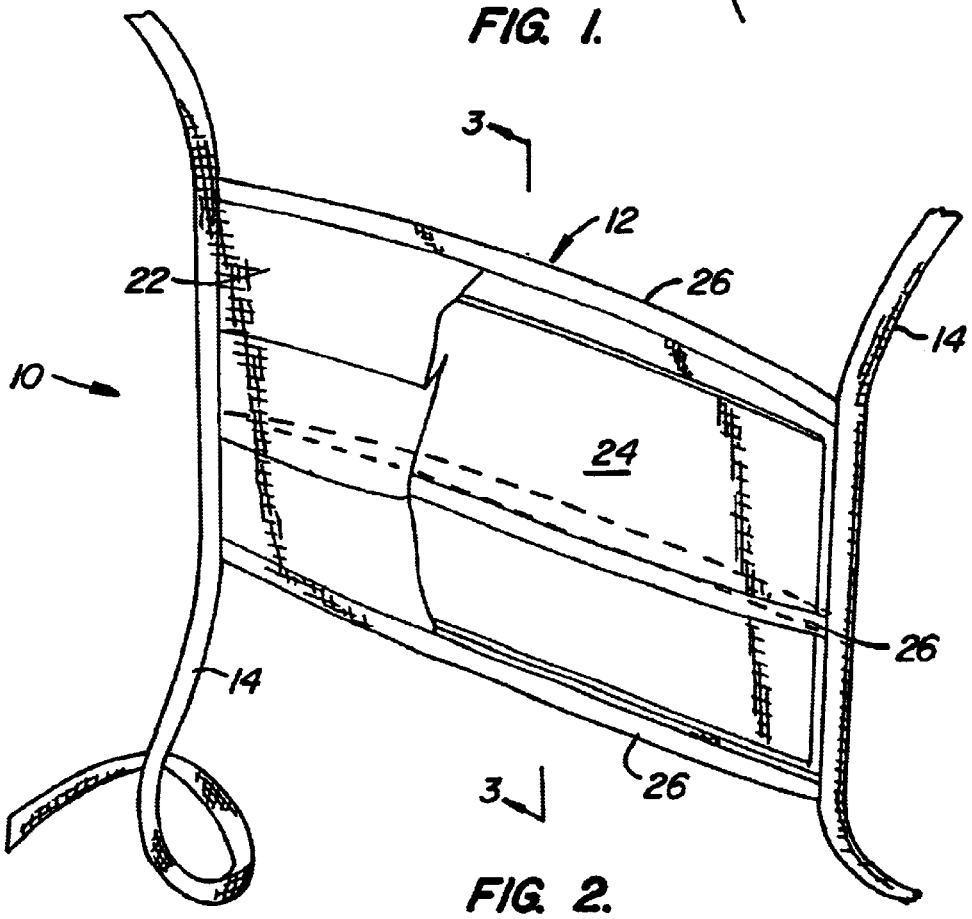
FIG. 2 shows a cutaway, perspective view of the surgical mask from FIG. 1.
Figure 3:
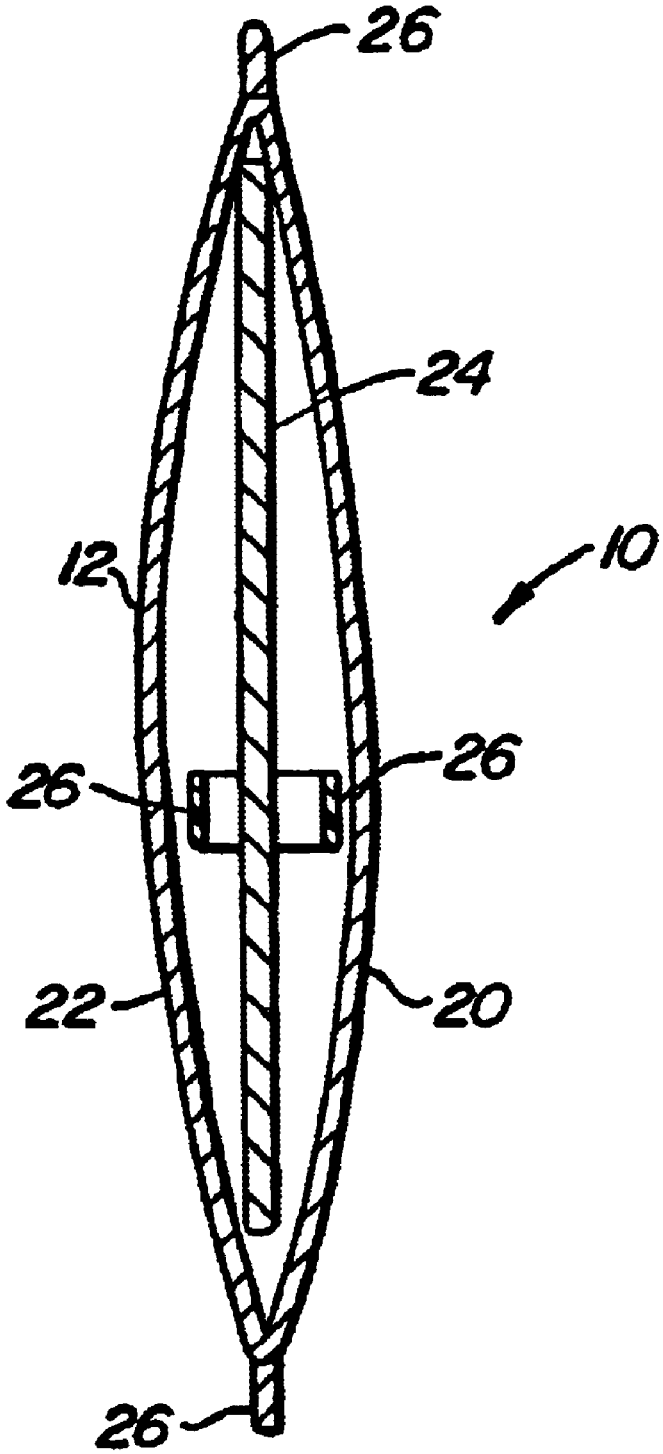
FIG. 3 shows a cross-sectional view of the surgical mask from FIGS. 1 and 2.

FIG. 1 shows a surgeon wearing a surgical mask 10 of the present invention. The surgical mask 10 has a facial portion 12 which covers the surgeon's mouth and nose as well as straps 14 which holds the surgical mask 10 onto the surgeon's face. As shown in FIGS. 2 and 3, the facial portion 12 of the surgical mask is primarily made up of three plies: an interior ply 20 situated next to the surgeon's face, an exterior ply 22 situated on the outside of the mask and a central liner 24. In its common, disposable form, the interior 20 and exterior 22 plies of the surgical mask 10 are made of paper and the central liner 24 is made of a breathable cloth material, such as gauze. Plastic or metal stays 26 are typically provided at the top, bottom and middle of the surgical mask 10 to help the surgical mask 10 retain its shape and enhance its seal.

As described thus far, the surgical mask 10 shown in FIGS. 1–3 is of conventional construction. A distinguishing aspect of the present invention is inexpensively imparting radiopaque qualities to such a surgical mask 10 without significantly diminishing its lightweight usability.

These radiopaque qualities can be imparted in a number of ways. In one preferred embodiment, the surgical mask of the present invention can be given radiopaque qualities by, prior to assembly, soaking or dipping its liner 24 in a high concentration solution of a relatively lightweight radiopaque compound, such as barium sulfate, or the reagents used to form the relatively lightweight radiopaque compound, such as barium chloride and sulfuric acid reagents to form a barium sulfate lightweight radiopaque compound. In the case of barium sulfate, this solution might advantageously be a 1 or 2 molar aqueous solution of barium sulfate precipitate (although other concentrations would also work). After the barium sulfate precipitate has been given an opportunity to thoroughly impregnate the liner 24 (e.g., by soaking overnight), the liner 24 can be removed from the barium sulfate solution and air dried. Drying can also be accomplished through use of a drying lamp or a microwave assembly. The impregnated liner 24 can then be placed between interior 20 and exterior 22 plies and sewn or sealed into the surgical mask 10 in a manner that is well known in the art. Since barium sulfate is capable of blocking x-rays, the impregnation of barium sulfate into a surgical mask liner 24 gives an otherwise conventionally constructed surgical mask 10 the ability to block x-rays from harming the surgeon's face, while still allowing breathability.

To improve the efficiency of the impregnation process, various additives can advantageously be used. These additives can include adhesives, fixatives and/or emulsifiers to enhance the adhesion and/or thicken the solution of the lightweight radiopaque compound.

For example, an adhesive, such as Gum Arabic or Guar Gum, might be added to the previously mentioned barium sulfate solution to both thicken the solution and increase the adhesion of barium sulfate to the mask material. Alternatively, the adhesive might be added to the mask material, rather than the barium sulfate solution. The pretreated mask material would then be soaked or dipped in the barium sulfate solution.

In addition to being soaked or dipped in a premade solution containing lightweight radiopaque compounds, the relatively lightweight radiopaque materials of the present invention can also be impregnated into the liner 24 of a surgical mask 10 using alternative techniques. Where the radiopaque material is in particulate form in solution (e.g., as a precipitate), one alternative technique is to choose a liner with pores that are smaller in size than the particles of radiopaque material but larger in size than the solvent (e.g., water or alcohol) used for the radiopaque solution. The radiopaque solution can then be passed through the surgical mask liner 24 in a manner where the liner will act as a filter to filter out the radiopaque particles while allowing the solvent to pass through. In the case of an aqueous solution containing barium sulfate precipitate, the filter pore size should be on the order of 2 microns and correspond to Whatman's pore size 5. Similarly, the solution of radiopaque particles can be sprayed onto the liner. Again, after the liner 24 has been sufficiently impregnated with the radiopaque compound, it can then be dried and assembled into a surgical mask in the conventional manner.

In an second alternative embodiment, a reaction chamber can be created with a solution of one reagent used to create the radiopaque compound on one side, a solution of the complementary reagent used to create the radiopaque compound on the other side and a liner 24 placed in the middle. In the case of a barium sulfate radiopaque compound, these reagents might be barium chloride and sulfuric acid. In this barium sulfate example, because of the natural attraction of barium chloride to sulfuric acid, a chemical reaction will occur within liner 24 between the barium chloride and sulfuric acid which will leave behind a barium sulfate precipitate in liner 24.

In a third alternative, the liner 24 can be formed with one reagent incorporated within the liner 24 (e.g., as either a compound or free radical) and then exposed to the other reagent in order to create a resulting radiopaque impregnation. Again, in the case of a barium sulfate radiopaque compound, the liner 24 might advantageously be formed with barium or sulfate as part of the liner 24 and then exposed to the other compound in order to create the barium sulfate impregnation.

Barium sulfate is a preferred radiopaque precipitate for the present invention because, as compared with lead, for example, it is lighter in weight, inexpensive, promotes breathability and has fewer known heath hazards. Other lightweight radiopaque materials can also used to impregnate fabric for the present invention in a manner similar to that already described. These other lightweight radiopaque materials include, but are not limited to, barium, other barium compounds (e.g., barium chloride), tungsten, tungsten compounds (e.g., tungsten carbide and tungsten oxide), bismuth, bismuth compounds, HYPAQUE™, Acetrizoate Sodium, Bunamiodyl Sodium, Diatrizoate Sodium, Ethiodized Oil, Iobenzamic Acid, Iocarmic Acid, ocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium. These radiopaque materials for the present invention can be purchased from a variety of chemical supply companies such as Fisher Scientific, P.O. Box 4829, Norcross, Ga. 30091 (Telephone: 1-800-766-7000), Aldrich Chemical Company, P.O. Box 2060, Milwaukee, Wis. (Telephone: 1-800-558-9160) and Sigma, P.O. Box 14508, St. Louis, Mo. 63178 (Telephone: 1-800-325-3010). Those of skill in the art will readily recognize that other relatively lightweight radiation protective materials incorporating the same metals can be used interchangeably with the ones previously listed.

While the radiopaque impregnation examples provided thus far have been for a surgical mask liner 24, those of skill in the art will recognize that the principles of this invention can also be applied to a wide range of other applications. For example, rather than just the liner 24, the entire surgical mask 10 could be impregnated with a radiopaque compound of the present invention (e.g., barium sulfate or HYPAQUE™) in the manner previously described. It should be noted that this is a less preferred embodiment because the side of the surgical mask which comes in contact with the user's face should preferably be left untreated. Besides surgical masks, any number of other garments such as hoods, gowns, gloves, patient drapes, coverings, booties, jumpsuits, uniforms, fatigues etc. could be given radiopaque qualities in the manner previously described.

Figure 4:
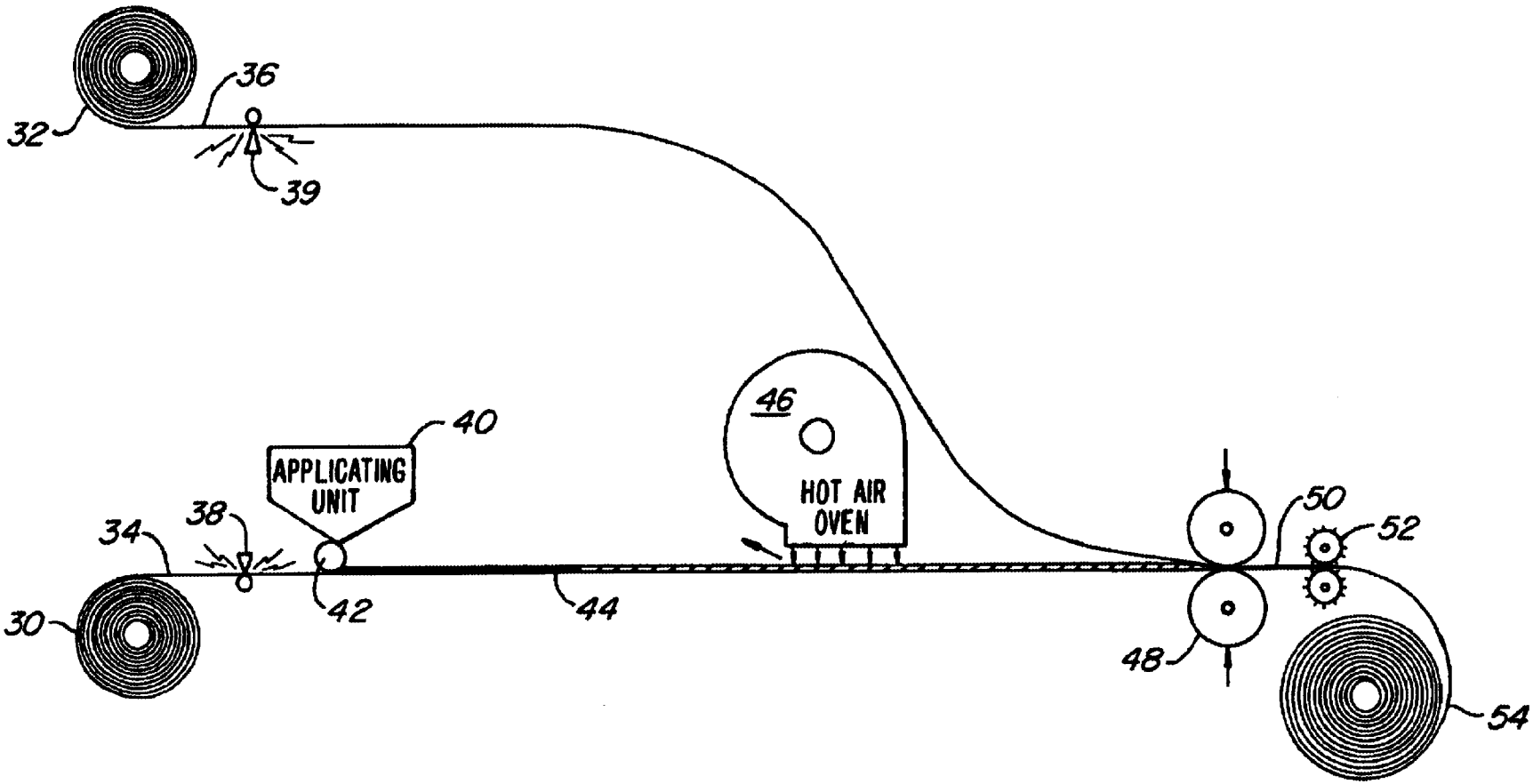
FIG. 4 shows a preferred process for forming a relatively lightweight radiation protective fabric or other material by applying a liquid polymer incorporating a relatively lightweight radiopaque material between two sheets.

A manufacturing technique that is particularly suited for mass production of relatively lightweight radiopaque fabrics or other flat, pliable materials for use in garments and other articles involves mixing relatively lightweight radiopaque compounds with polymers and then applying the polymerized mixture to the fabrics or other materials. FIG. 4 illustrates one preferred embodiment of such a process. The FIG. 4 process begins with one or more rolls 30, 32 of fabric or other flat, pliable material 34, 36 to which the polymer mixture will be applied. A non-woven, polymeric fabric, such a polypropylene, polyethylene, rayon or any mixture of these is preferred for this process because these polymeric fabrics have been found to bind well with the liquid polymeric mixture. Alternatively, this process may also be accomplished using woven fabrics and other flat, pliable materials, such sheets of paper or films. To enhance the ability of the fabric or other material 34, 36 to bind with the polymer mixture, an electrostatic charge may be applied to the fabric or other material by one or more corona treaters 38, 39.

In this process, the liquid polymer mixture is applied to one side of the unwound fabric or other material 34 through the use of an applicating unit 40. This applicating unit 40 would typically have a roller 42 to roll a thin layer (e.g., preferably 0.1–20 millimeters in thickness) of the liquid polymeric mixture onto one side of an unwound fabric or other material 34. The liquid polymeric mixture preferably includes a polymer, a radiopaque compound and one or more additives. The liquid polymer may be selected from a broad range of plastics including, but not limited to, polyurethane, polyamide, polyvinyl chloride, polyvinyl alcohol, natural latex, polyethylene, polypropylene, ethylene vinyl acetate and polyester. The additives are typically chemicals to improve the flexibility, strength, durability or other properties of the end product and/or to help insure that the polymeric mixture has an appropriate uniformity and consistency. These additives might be, in appropriate cases, plasticizers (e.g., epoxy soybean oil, ethylene glycol, propylene glycol, etc.), emulsifiers, surfactants, suspension agents, leveling agents, drying promoters, flow enhancers etc. Those skilled in the plastic processing arts are familiar with the selection and use of such additives.

The proportions of these various polymeric mixture ingredients can vary. Using a greater proportion of radiopaque compound will generally impart greater radiation protection. Nonetheless, if the proportion of radiopaque compound is too high, the polymeric mixture will become brittle when dried and easily crumble apart. The inventors have found from their work with barium sulfate that over 50% of the polymeric mixture, by weight, can be barium sulfate or other lightweight radiopaque compounds, with most of the rest of the mixture consisting of the polymer. In one case, the inventors created a polymeric mixture of 85% by weight of barium sulfate and 15% by weight of polymer.

After the applicating unit 40, the polymerized fabric 44 is then preferably passed through a hot air oven 46 to partially dry the thin layer of polymeric mixture before it is sent into a laminating unit 48. At the laminating unit 48, the coated fabric 44 is preferably combined under heat and pressure with a second sheet of fabric or other material 36 to create a sandwich-like radiation protective product 50. The sandwich-like radiation protective fabric or other material can then be perforated and/or embossed, as desired, in a perforating/embossing unit 52. Typically, the finished radiation protective product will then be wound into a final roll 54 to be shipped to a suitable location for use in fabricating garments or other articles. While two layers of fabric or other material 34, 36 have been shown in this FIG. 4 example, one could alternatively apply the polymeric mixture to a single sheet of fabric or other material 34 (i.e., like an open faced sandwich).

Figure 6:
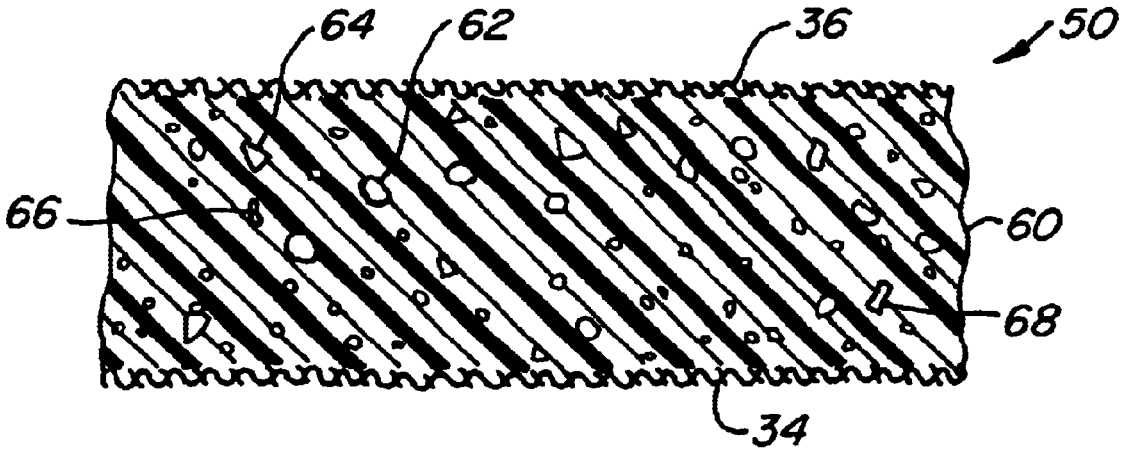
FIG. 6 shows a cross-section a relatively lightweight radiation protective fabric or other material having a central polymer layer with multiple forms of radiopaque materials.

A sandwich-like radiation protective fabric product 50 of the type produced using the FIG. 4 process is illustrated in a cross-sectional view in FIG. 6. In the FIG. 6 illustration, an intermediate polymeric layer 60, which includes radiopaque materials in addition to the polymers, is sandwiched between two layers of fabric or other material 34, 36. In the illustration of FIG. 6, the intermediate polymeric layer 60 includes several types of radiopaque compounds 62, 64, 66, 68. These radiopaque compounds 62, 64, 66, 68 could be, for example, a barium compound 62, a tungsten compound 64, a bismuth compound 66 and an iodine compound 68. By using a plurality of different radiopaque compounds, the radiation protective article can be more effective in blocking different forms of radiation than a similar article with a single radiopaque compound. For example, some radiopaque compounds might be more effective in blocking beta rays, while others will be more effective in blocking gamma rays. By using both types of radiopaque compounds in the radiation protective fabric or other material of the present invention, the article will have a greater ability to block both beta and gamma rays.

In this regard, it may be appropriate to consider the use of lead as one of the radiopaque compounds for such a hybrid application, or even more generally for the type of plasticized articles disclosed herein. While, because of its heavy weight and potential health hazards, lead would not be as preferred as the relatively lightweight radiopaque compounds previously listed, lead nonetheless might have a role in a plasticized radiopaque compound mixture or in certain other plastic film applications.

Figure 8:
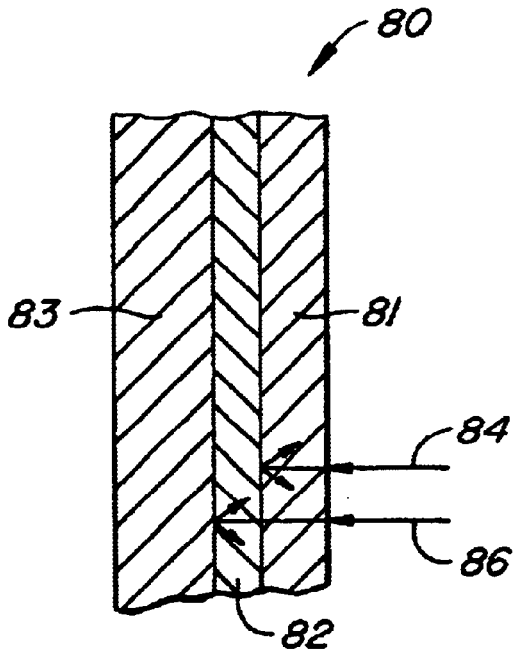
FIG. 8 shows a cross-section of a multiple layer radiation protective article which provides enhanced radiation protection.

FIG. 8 shows a second approach to enhancing radiation protection through a particular multi-layer construction 80. Each of the layers 81, 82, 83 of this multi-layer product 80 have different thicknesses. While a layer of one thickness 81 might be capable of stopping radioactive particles 84 with certain wave characteristics, it might allow radioactive particles of different wave characteristics 86 to pass right through. Nonetheless, by backing up the first layer 81 with additional layers of different thicknesses, there is a greater chance of stopping radioactive particles regardless of their wave characteristics. As those in the art will recognize, a synergistic effect might be achieved by combining the different radiopaque compounds 62, 64, 66, 68 as shown in FIG. 6 with the use of layers of different thicknesses 81, 82, 83 as shown in FIG. 8 in order to create a radiation protective article that offers the maximum amount of radiation protection for a given weight and thickness.

Figure 5:
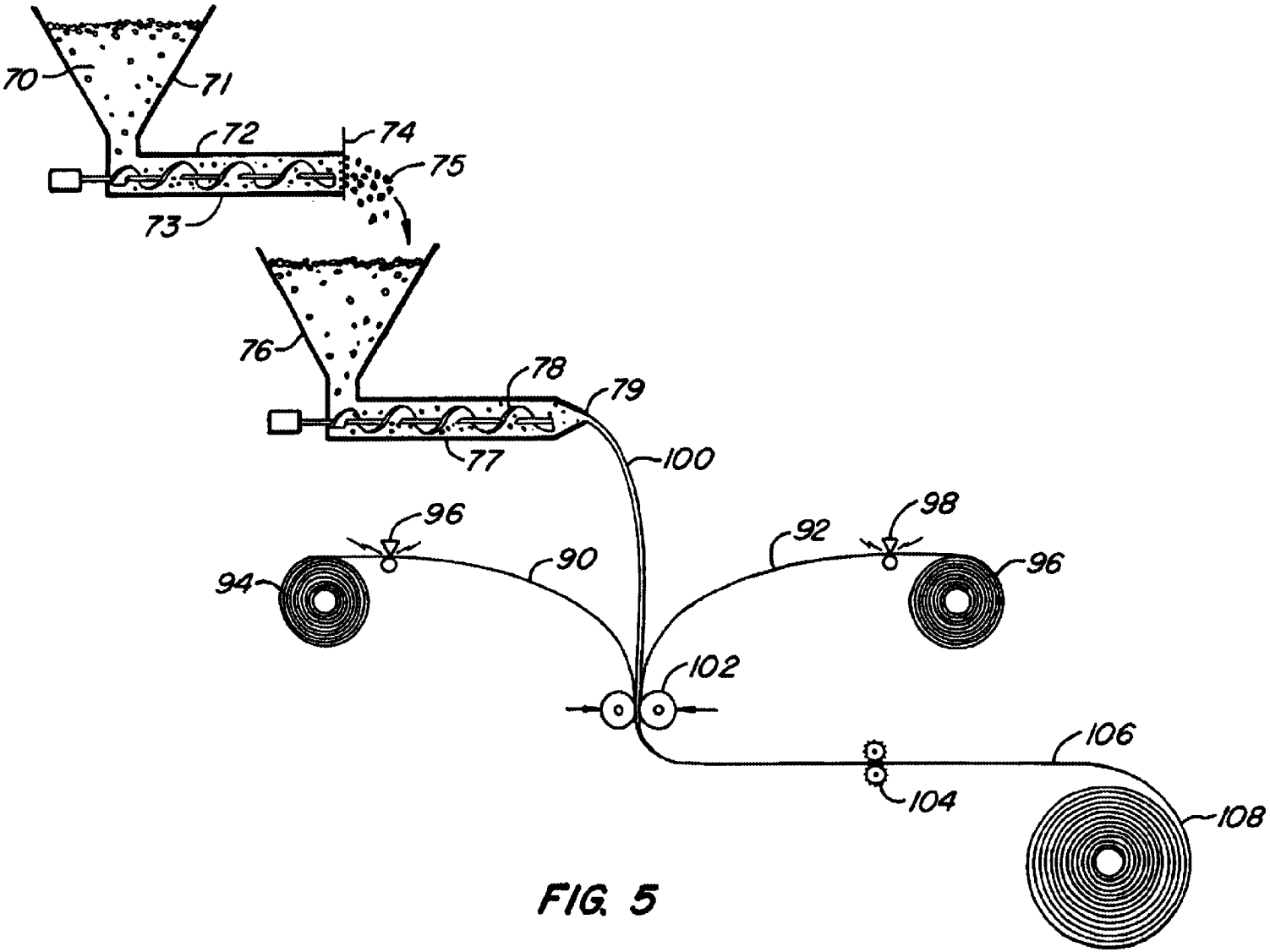
FIG. 5 shows an alternative process for forming a relatively lightweight radiation protective fabric or other material.

Turning now to FIG. 5, an alternative mass production process is shown. In the FIG. 5 process, the polymeric mixture ingredients 70 are placed into the hopper 71 of a first extruder 72. As before, the polymeric mixture would preferably include a polymer, a radiopaque material and one or more additives. In this process, these polymeric mixture ingredients 70 can enter the hopper 71 in a solid form. As the hopper 71 feeds the polymeric mixture ingredients 70 into the first extruder 72, the polymeric mixture ingredients are preferably heated into a viscous liquid state and mixed together through the turning action of the motorized extruder screw 73. As this motorized extruder screw 73 pushes the polymeric mixture ingredients out of the first extruder 72, the combination of a perforated plate and rotary cutter 74 chops the exiting polymeric mixture into pellets 75. These pellets 75 are then preferably inserted into the hopper 76 of a second extruder 77. Again, through heating and a motorized screw 78, the polymeric mixture is melted. This time, when the polymeric mixture ingredients are pushed out of the extruder 77, a slotted plate at the end of the second extruder 79 is used to extrude a thin film of liquefied polymeric mixture 100. This thin film might advantageously be on the order of 0.1–20 millimeters thick. In order to simplify the process steps, this thin film 100 could be produced by the first extruder 72 alone. Nonetheless, by eliminating the second extruder 77, there is a greater chance that the polymeric mixture will not be evenly mixed before it is extruded.

As with the preferred FIG. 4 process, the liquefied polymeric mixture in the FIG. 5 process is sandwiched between two sheets of fabric or other material 90, 92. As before, the fabric sheets are preferably unwound from fabric rolls 94, 96. Corona treaters 96, 98 may again be used to apply an electrostatic charge to enhance the binding process. In this case, the thin film of liquefied polymeric mixture 100 is applied simultaneously between both sheets of fabric or other material 90, 92. Once the thin film of liquefied polymeric mixture 100 is inserted between the two sheets 90, 92, the two sheets are then preferably compressed and heated between the rollers of a laminating unit 102 and perforated and/or embossed, as desired, in a perforating/embossing unit 104. For convenient storage, the finished radiation protective fabric or other material 106 can then be wound into a final roll 108.

Figure 10:
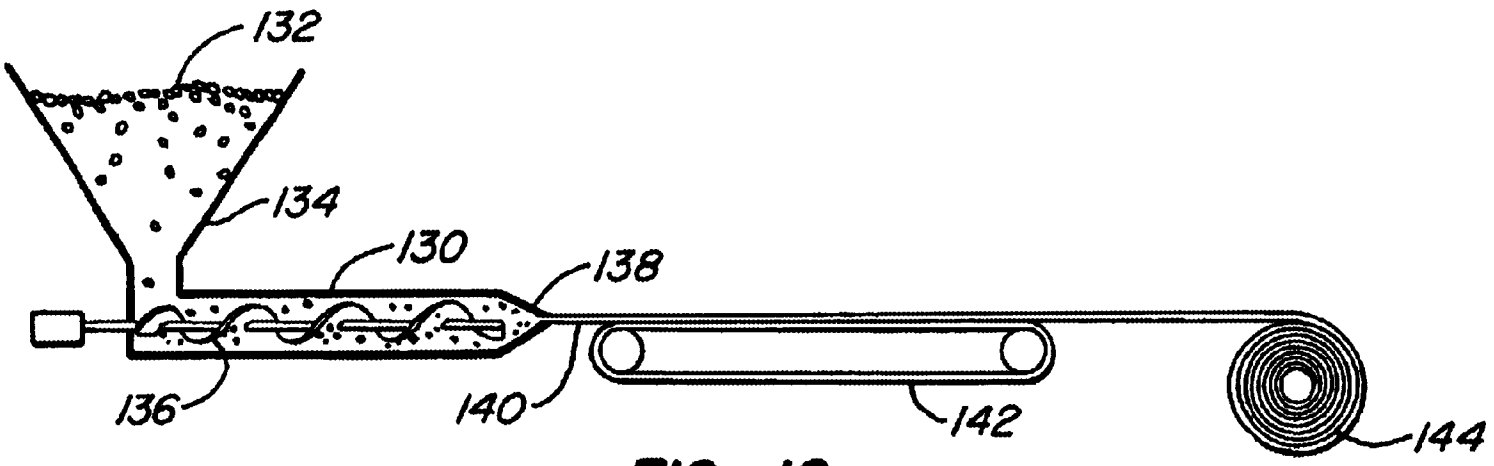
FIG. 10 shows a preferred process for producing a polymer film incorporating relatively lightweight radiopaque materials.

Turning now to FIG. 10, a process is shown for forming a free standing film of radiation protective polymer, which does not need to be attached to a fabric or other material. Like the FIG. 5 process, this protective film process preferably starts by putting a mixture of a suitable polymer, radiopaque compound and any appropriate additives 132 in the hopper 134 of an extruder 130. As the hopper 134 feeds the polymer mixture into the extruder 130, the polymer mixture is heated into a viscous liquid state and churned by the motorized extruder screw 136. As the motorized extruder screw 136 pushes the polymeric mixture out of the extruder 130, a slotted plate at the end of the extruder 138 produces a film of radiation protective polymer which is deposited on endless conveyor belt 142 and cooled. The endless conveyor belt preferably has a polished metal or TEFLON™ coating in order to prevent the film from needlessly sticking to the conveyor belt 142. To speed up the cooling process, a fan, blower or refrigeration unit (not shown) may be used. When the radiation protective film 140 has sufficiently cooled, it can be wound into a final roll 144 for convenient storage. The final roll of radiation protective film 140 can then be used for any number of the applications discussed herein, including the manufacture of garments, tents, envelopes, wallpaper, liners, house sidings etc.

Figure 11:
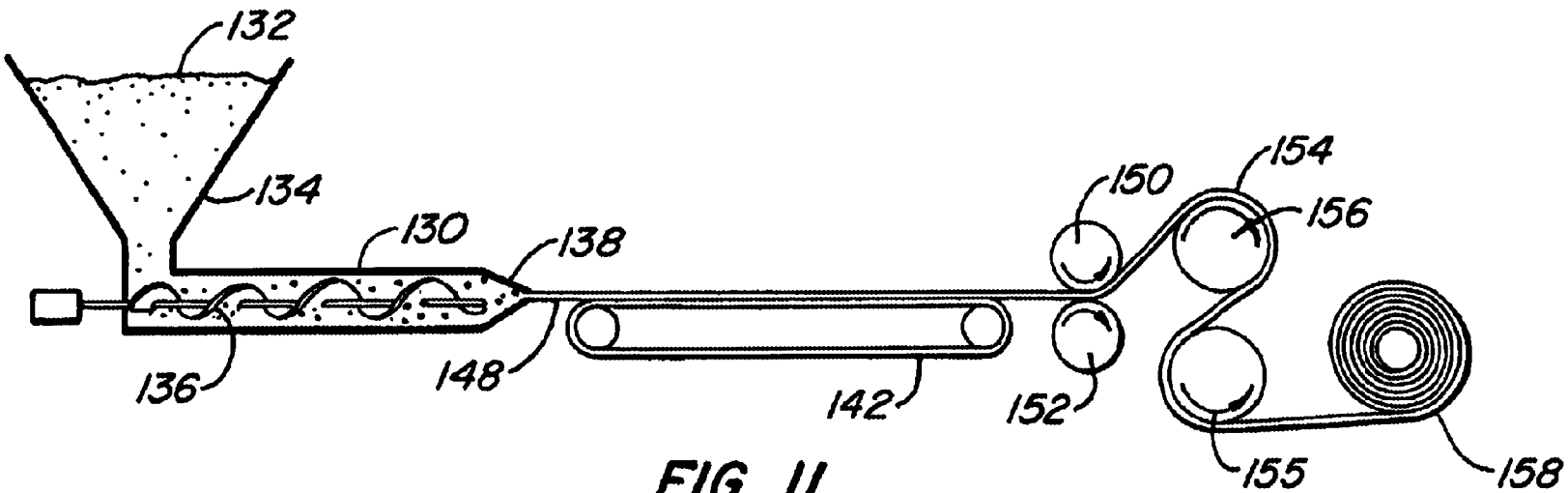
FIG. 11 shows an alternative process for producing a polymer film incorporating relatively lightweight radiopaque materials.

FIG. 11 shows a variation of the process illustrated in FIG. 10. Like the FIG. 10 process, the FIG. 11 process begins by putting the polymeric mixture 132 into the hopper 134 of an extruder 130. As the hopper 134 feeds the polymer mixture into the extruder 130, the polymer mixture is again heated and churned by the motorized extruder screw 136. This time, though, the polymer mixture is preferably heated to the consistency of a paste, rather than into a viscous liquid state. As the motorized extruder screw 136 pushes the polymeric mixture out of the extruder 130, a slotted plate at the end of the extruder 138 again produces a film of radiation protective polymer 148 which is deposited on endless conveyor belt 142. This time, when the pasty film 148 exits the endless conveyor belt 142, it is fed into calender rollers 150, 152 which simultaneously heat and compress the pasty film 148. During this calendering process, the polymer molecules will typically cross-polymerize to form even stronger polymer molecules. After leaving the calender rollers 150, 152, the finished film 154 is pulled by take up rollers 155, 156 and then preferably wound into a final roll 158 for convenient storage and later use.

Thus far, techniques have been described for imparting radiopaque qualities into a fabric or other material through impregnation with relatively lightweight radiopaque materials, with or without the use of polymers. In another alternative embodiment, sheets of radiopaque materials, such as aluminum, can be inserted between the plies of an article to impart radiopaque qualities. For example, liner 24 of surgical mask 10 could be a sheet of aluminum foil. To provide breathability, this sheet of aluminum foil could be perforated with multiple holes (not shown). Breathability and protection can also be provided by staggering partial layers of radiopaque sheets with layers of porous cloth liners or staggering perforated radiopaque sheets.

Figure 7:
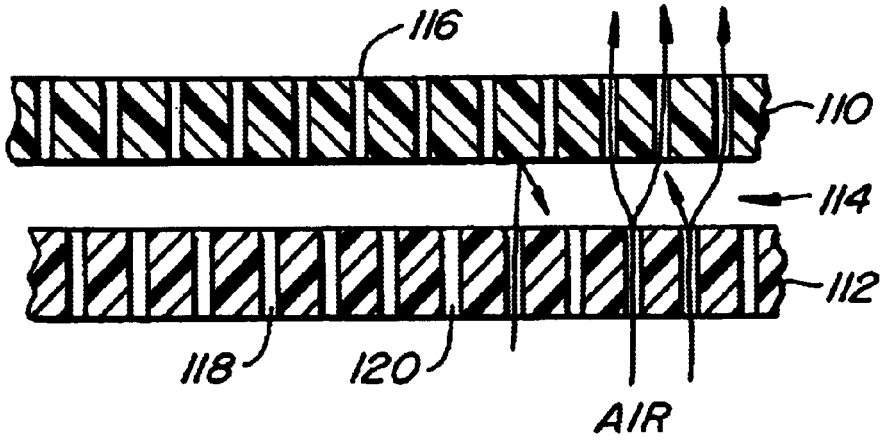
FIG. 7 shows a cross-section of a two layer radiation protective fabric which illustrates how the fabric can be made both breathable and radiation protective.

One staggering embodiment is illustrated in FIG. 7. As shown in FIG. 7, two sheets of fabric or other material 110, 112 incorporating radiopaque materials are separated by a gap 114. Both of these two sheets 110, 112 have been perforated to create patterns of holes 116, 118, 120. By offsetting the holes 116, 118, 120 in the two sheets 110, 112 as shown in FIG. 7, radioactive particles, which travel in an essentially straight line, would be blocked by at least one of the two sheets while air, which can bend around obstructions, will still be allowed to pass through. This staggering approach can be particularly useful for applications that demand breathability, such as the surgical mask 10 shown in FIG. 1.

In the same vein, the radiopaque material, such as the polymeric mixtures previously described or aluminum, could be formed into tubes, cylinders or threads and woven into a garment or interwoven with conventional garment material, such as cloth, to provide both the flexibility of a cloth garment and the x-ray protection of metallic garment. The radiopaque material could also be incorporated within a variety of clear plastics or glass to create, for example, a clear eye shield with radiopaque qualities.

In the foregoing specification, the invention has been described with reference to specific preferred embodiments and methods. It will, however, be evident to those of skill in the art that various modifications and changes may be made without departing from the broader spirit and scope of the invention as set forth in the appended claims. For example, a number of the preferred embodiments previously described have been in the field of medicine. Nonetheless, those of skill in the art know that radiation problems occur in many other fields, such as nuclear and electrical power, aviation and the military. For example, the amount of radiation a passenger is exposed to in a cross-country airplane flight is actually greater than the radiation exposure of a chest x-ray. To protect such airline passengers and, more urgently, the people who operate such airplanes on a daily basis, the type of plasticized radiation protective fabrics produced by the processes shown in FIGS. 4 and 5 or plasticized radiation protective films produced by the processes shown in FIGS. 10 and 11 could, for example, be glued as an interior liner into airplane cabins. Similarly, the glass used for airplanes windows could be manufactured to incorporate the type of lightweight radiopaque materials described herein. The plasticized radiation protective fabrics or other materials of the present invention could also be formed into envelopes or pouches to protect radiation sensitive materials (e.g., photographic film, electronics) from being damaged when they are x-rayed at airports. These pouches or envelopes could also be used to safely transport radioactive materials, such as radioactive products or nuclear waste.

Figure 9:
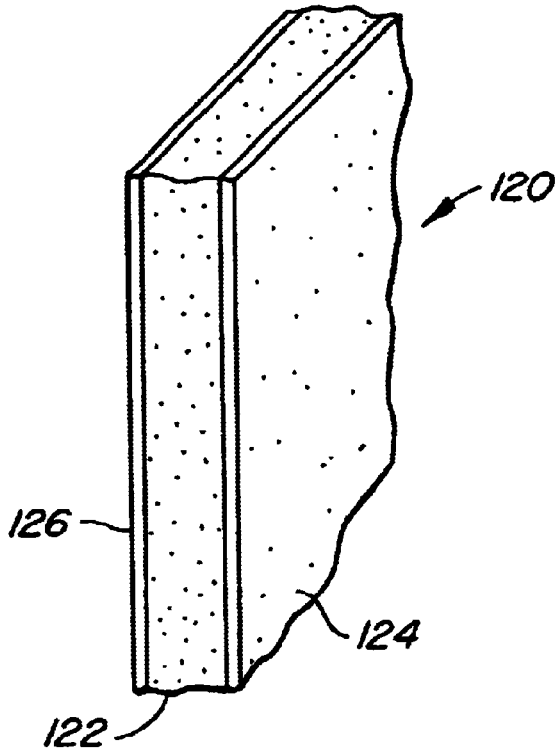
FIG. 9 shows a cross-section of radiation protective drywall incorporating a relatively lightweight radiation protective material of the present invention.

As another example, FIG. 9 shows how the lightweight radiopaque materials of the present invention could be incorporated into common drywall 120. In this case, the relatively lightweight radiopaque materials of the present invention, such as barium sulfate, could be mixed with the gypsum commonly used in drywall and then inserted 122 between two layers of cardboard 124, 126.

Figure 12:
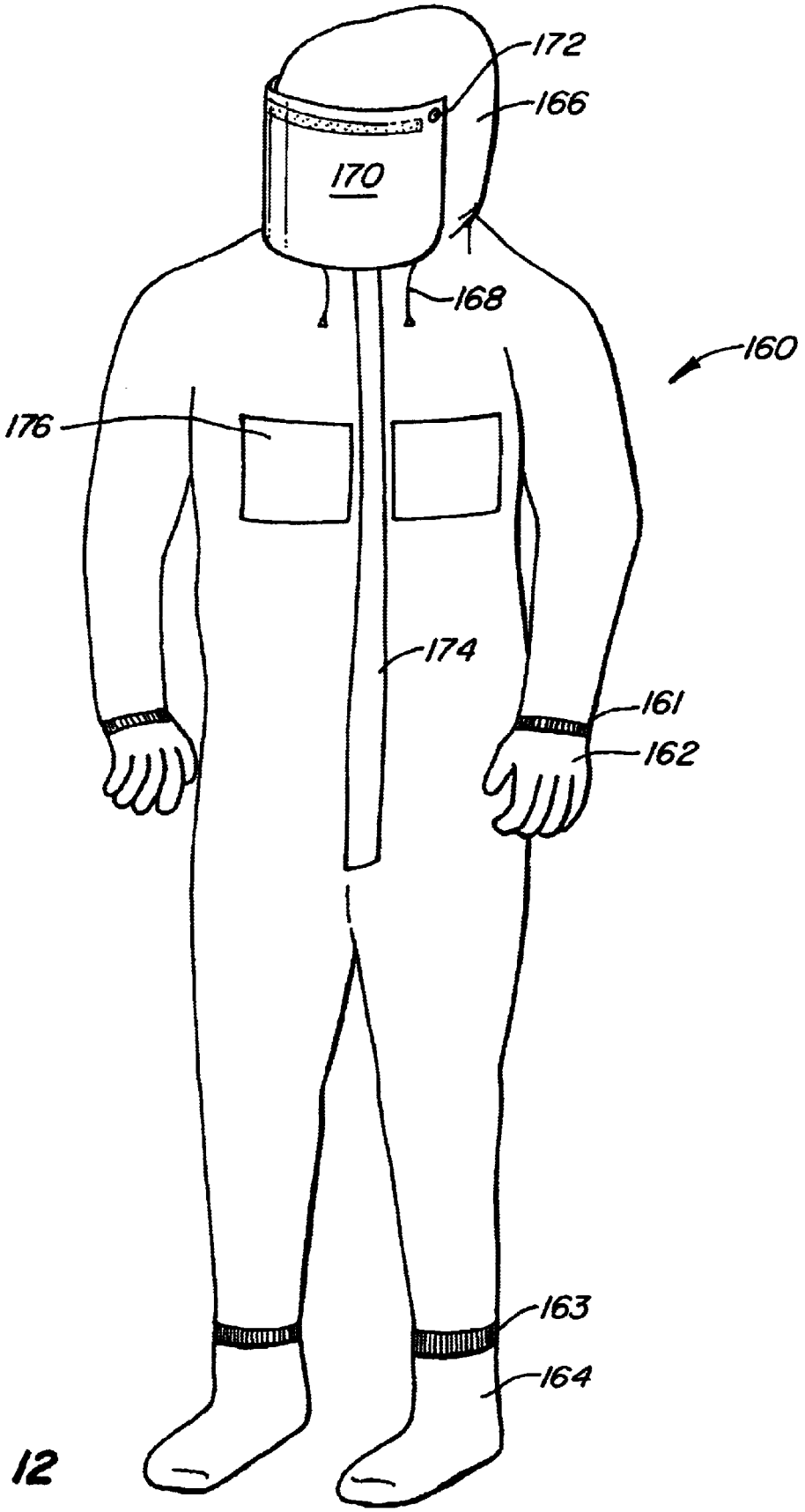
FIG. 12 shows a front view of a jumpsuit constructed with relatively lightweight radiation protective fabrics or films of the present invention.

As a further example, FIG. 12 shows a jumpsuit 160 which is constructed with the relatively lightweight radiation protective materials of the present invention. In one preferred embodiment, the radiation protective fabrics produced by the processes shown in FIGS. 4 and 5 or the radiation protective films produced by the processes shown in FIGS. 10 and 11 could be used to manufacture such a radiation protective jumpsuit. To provide the most protection, the jumpsuit 160 should probably be a one-piece jumpsuit which covers nearly every portion of the human body. Elastic bands 161, 163 can be used around the hand and foot areas to help insure a tight fit. Alternatively, the gloves 162, booties 164 and hood 166 could be separate pieces which overlap with the rest of the jumpsuit in a way which leaves no skin surface exposed. The hood 166 preferably includes drawstrings 168 so that it can be fit tightly against the wearer's head.

A transparent eye shield 170 is preferably included with the jumpsuit 160 to provide protection for the face. As previously discussed, this eye shield 170 can be manufactured with the same sorts of radiation protective polymeric mixtures that have been used in the previous embodiments to produce rolls of radiation protective fabric or other materials. In the case of clear eye shields, though, an injection molding process of the type well known in the plastic arts would be preferable to the continuous roll processes previously discussed. For convenience, the eye shield 170 could be hinged, such as with corner rivets 172, in order to allow the user to flip the shield 170 up and down. Alternatively, the eye protection could be a stand alone device, such as safety glasses. The jumpsuit 160 can also include a VELCRO™ or zipper flap 174 to allow the user to easily enter the jumpsuit 160, while still providing radiation protection. Pockets 176 can also be included to hold useful items, such as a Geiger counter.

As a still further example, the lightweight radiopaque materials of the present invention could be finely ground up and mixed into latex or oil based paints. Emulsifiers, binding agents or suspension agents may be added to such paints to keep the lightweight radiopaque materials well mixed so that they do not precipitate out of solution, emulsion or suspension. Through the addition of such radiopaque materials, radiation protection can be painted or coated onto any number of surfaces in order to provide protection from the dangers of radiation.

Those of skill in the art will readily understand that the principles and techniques described in this application are applicable to any field where radiation is present. The specification and drawings are, accordingly, to be regarded in an illustrative, rather than restrictive sense; the invention being limited only by the appended claims.

What is claimed is:

1. A radiation protective article comprising fabric or other pliable material to which a polymeric mixture is adhered, wherein said polymeric mixture includes a polymer and a relatively lightweight radiation protective material.

2. The radiation protective article of claim 1 wherein said relatively lightweight radiation protective material is selected from the group consisting of barium, barium compounds, bismuth, bismuth compounds, tungsten and tungsten compounds.

3. The radiation protective article of claim 1 wherein said relatively lightweight radiation protective material is selected from the group consisting of barium sulfate, barium chloride, tungsten carbide, tungsten oxide, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

4. The radiation protective article of claim 1 wherein at least some of said fabric or other pliable materials is perforated.

5. The radiation protective article of claim 1 wherein said radiation protective material comprises at least 50% of said polymeric mixture by weight.

6. The radiation protective article of claim 1 further comprising a plurality of radiation protective materials in said polymeric mixture.

7. The radiation protective article of claim 1 wherein said article is a jumpsuit.

8. The radiation protective article of claim 1 wherein said article is a liner.

9. The radiation protective article of claim 1 wherein said article is a surgical mask.

10. The radiation protective article of claim 1 wherein said article is a pouch or envelope.

11. The radiation protective article of claim 1 wherein said article is wallpaper.

12. The radiation protective article of claim 1 wherein said lightweight radiation protective material includes tungsten or a tungsten compound.

13. The radiation protective article of claim 1 wherein said polymer is selected from the group consisting of polyurethane, polyamide, polyvinyl chloride, polyvinyl alcohol, natural latex, polyethylene, polypropylene, ethylene vinyl acetate and polyester.

14. The radiation protective article of claim 1 wherein a layer of said polymeric mixture is interposed between two layers of said fabric or other pliable material in said article.

15. The radiation protective article of claim 1 further comprising multiple layers of polymeric mixture having different thicknesses.

16. The radiation protective article of claim 1 wherein said fabric or other pliable material is a non-woven polymeric fabric.

17. The radiation protective article of claim 1 wherein said fabric is non-woven and selected from the group consisting of polypropylene, polyethylene and rayon.

18. The radiation protective article of claim 1 wherein said fabric or other pliable material is paper or film.

19. A radiation protective article comprising a woven fabric to which a polymeric mixture is adhered, wherein said nolymeric mixture includes a polymer and a relatively lightweight radiation protective material.

20. The radiation protective article of claim 19 wherein said relatively lightweight radiation protective material is selected from the group consisting of barium, barium compounds, bismuth, bismuth compounds, tungsten and tungsten compounds.

21. The radiation protective article of claim 19 wherein said relatively lightweight radiation protective material is selected from the group consisting of barium sulfate, barium chloride, tungsten carbide, tungsten oxide, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

22. The radiation protective article of claim 19 wherein said radiation protective material comprises at least 50% of said polymeric mixture by weight.

23. The radiation protective article of claim 19 wherein said polymer is selected from the group consisting of polyurethane, polyamide, polyvinyl chloride, polyvinyl alcohol, natural latex, polyethylene, polypropylene, ethylene vinyl acetate and polyester.

24. The radiation protective article of claim 19 wherein said article has a plurality of layers of different thicknesses.

25. A radiation protective article comprising fabric or other pliable material over which a liquid polymeric mixture is coated, wherein said polymeric mixture includes a polymer and a relatively lightweight radiation protective material.

26. The radiation protective article of claim 25 wherein said relatively lightweight radiation protective material is selected from the group consisting of barium, barium compounds, bismuth, bismuth compounds, tungsten and tungsten compounds.

27. The radiation protective article of claim 25 wherein said relatively lightweight radiation protective material is selected from the group consisting of barium sulfate, barium chloride, tungsten carbide, tungsten oxide, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalaniic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

28. The radiation protective article of claim 25 wherein said radiation protective material comprises at least 50% of said polymeric mixture by weight.

29. The radiation protective article of claim 25 further comprising a plurality of radiation protective materials in said polymeric mixture.

30. The radiation protective article of claim 25 wherein said lightweight radiation protective material includes tungsten or a tungsten compound.

31. The radiation protective article of claim 25 wherein said polymer is selected from the group consisting of polyurethane, polyamide, polyvinyl chloride, polyvinyl alcohol, natural latex, polyethylene, polypropylene, ethylene vinyl acetate and polyester.

32. The radiation protective article of claim 25 wherein a layer of said polymeric mixture is interposed between two layers of said fabric or other pliable material in said article.

33. The radiation protective article of claim 25 wherein said fabric or other pliable material is a woven fabric.

34. The radiation protective article of claim 25 wherein said fabric or other pliable material is non-woven.

35. The radiation protective article of claim 25 wherein said fabric or other pliable material is paper or film.

36. A method for producing a radiation protective article comprising the steps of:

mixing a relatively lightweight radiation protective material with a polymer to create a polymeric mixture;

adhering said polymeric mixture to a fabric or other pliable material to make said fabric or other pliable material radiation protective; and, constructing a functional article from said radiation protective fabric or other pliable material.

37. The method of claim 36 wherein said relatively lightweight radiation protective material is selected from the group consisting of barium, barium compounds, bismuth, bismuth compounds, tungsten and tungsten compounds.

38. The method of claim 36 wherein said relatively lightweight radiation protective material is selected from the group consisting of barium sulfate, barium chloride, tungsten carbide, tungsten oxide, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

39. The method of claim 36 wherein at least some of said fabric or other pliable materials is perforated.

40. The method of claim 36 wherein said radiation protective material comprises at least 50% of said polymeric mixture by weight.

41. The method of claim 36 further comprising a plurality of radiation protective materials in said polymeric mixture.

42. The method of claim 36 wherein said polymeric mixture further comprises one or more additives.

43. The method of claim 36 wherein said polymeric mixture further comprises one or more additives selected from the group consisting of epoxy soybean oil, ethylene glycol and propylene glycol.

44. The method of claim 36 wherein said article is a jumpsuit.

45. The method of claim 36 wherein said article is a liner.

46. The method of claim 36 wherein said article is a surgical mask.

47. The method of claim 36 wherein said article is a pouch or envelope.

48. The method of claim 36 wherein said article is wallpaper.

49. The method of claim 36 wherein said lightweight radiation protective material includes tungsten or a tungsten compound.

50. The method of claim 36 wherein said polymer is selected from the group consisting of polyurethane, polyamide, polyvinyl chloride, polyvinyl alcohol, natural latex, polyethylene, polypropylene, ethylene vinyl acetate and polyester.

51. The method of claim 36 wherein said fabric or other pliable material is a non-woven polymeric fabric.

52. The method of claim 51 wherein said non-woven polymeric fabric is selected from the group consisting of polypropylene, polyethylene, polyester and rayon.

53. The method of claim 36 wherein said fabric or other pliable material is paper or film.

54. A method for producing a radiation protective article comprising the steps of:

mixing a relatively lightweight radiation protective material with a polymer to create a polymeric mixture;

heating said polymeric mixture until it assumes a liquid form;

applying said liquid polymeric mixture to a first sheet of fabric or other pliable material;

pressing a second sheet of fabric of other pliable material together with said first sheet of fabric or other pliable material so that a layer with said polymeric mixture is interposed between said first and second sheets of fabric or other pliable material; and, constructing an article from said radiation protective fabric or other pliable material composite.

55. The method of claim 54 wherein said relatively lightweight radiation protective material is selected from the group consisting of barium, barium compounds, bismuth, bismuth compounds, tungsten and tungsten compounds.

56. The method of claim 54 wherein said relatively lightweight radiation protective chemical is selected from the group consisting of barium sulfate, barium chloride, tungsten carbide, tungsten oxide, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

57. The method of claim 54 wherein said polymeric mixture is mixed and heated in one or more extruders and applied simultaneously from one of said extruders to said first and second sheets of fabric or other pliable material.

58. The method of claim 54 wherein said radiation protective material comprises at least 50% of said polymeric mixture by weight.

59. The method of claim 54 further comprising a plurality of radiation protective materials in said polymeric mixture.

60. The method of claim 54 wherein said polymeric mixture further comprises an additive.

61. The method of claim 54 wherein said polymer is selected from the group of polyurethane, polyamide, polyvinyl chloride, polyvinyl alcohol, natural latex, polyethylene, polypropylene, ethylene vinyl acetate and polyester.

62. The method of claim 54 wherein said fabric or other pliable material is a non-woven polymeric fabric or film.

63. The method of claim 54 wherein said fabric is non-woven and selected from the group consisting of polypropylene, polyester, polyethylene and rayon.

64. The method of claim 54 wherein said fabric or other pliable material is paper.

65. An article constructed by the process of claim 36.

66. An article constructed by the process of claim 54.

67. A method for producing a radiation protective film comprising the steps of:

mixing a relatively lightweight radiation protective material with a polymer to create a polymeric mixture;

heating said polymeric mixture in an extruder until it assumes a pliable form; and, forming said pliable polymeric mixture into a film by depositing it on an endless conveyor.

68. The method of claim 67 wherein said relatively lightweight radiation protective material is selected from the group consisting of barium, barium compounds, bismuth, bismuth compounds, tungsten and tungsten compounds.

69. The method of claim 67 wherein said relatively lightweight radiation protective chemical is selected from the group consisting of barium sulfate, barium chloride, tungsten, tungsten oxide, tungsten carbide, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

70. The method of claim 67 further comprising the step of pressing said pliable polymeric mixture between calender rollers.

71. The method of claim 67 wherein said radiation protective material comprises at least 50% of said polymeric mixture by weight.

72. The method of claim 67 further comprising a plurality of radiation protective materials in said polymeric mixture.

73. The method of claim 67 wherein said polymeric mixture further comprises an additive.

74. The method of claim 67 wherein said polymer is selected from the group of polyurethane, polyamide, polyvinyl chloride, polyvinyl alcohol, natural latex, polyethylene, polypropylene, ethylene vinyl acetate and polyester.

75. The method of claim 36 wherein said polymeric mixture is a liquid suspension, emulsion or solution.

76. A method for producing a radiation protective article comprising the steps of:

mixing a relatively lightweight radiation protective material with a polymer to create a polymeric mixture;

heating said polymeric mixture until it liquefies;

coating said liquefied polymeric mixture onto a fabric or other pliable material to make said fabric or other pliable material radiation protective; and, constructing a functional article from said radiation protective fabric or other pliable material.

77. The method of claim 76 wherein said relatively lightweight radiation protective material is selected from the group consisting of barium, barium compounds, bismuth, bismuth compounds, tungsten and tungsten compounds.

78. The method of claim 76 wherein said relatively lightweight radiation protective material is selected from the group consisting of barium sulfate, barium chloride, tungsten carbide, tungsten oxide, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

79. The method of claim 76 wherein said radiation protective material comprises at least 50% of said polymeric mixture by weight.

80. The method of claim 76 comprising a plurality of radiation protective materials in said polymeric mixture.

81. The method of claim 76 wherein said polymeric mixture further comprises one or more additives.

82. The method of claim 76 wherein said lightweight radiation protective material includes tungsten or a tungsten compound.

83. The method of claim 76 wherein said polymer is selected from the group consisting of polyurethane, polyamide, polyvinyl chloride, polyvinyl alcohol, natural latex, polyethylene, polypropylene, ethylene vinyl acetate and polyester.

84. The method of claim 76 wherein said fabric or other pliable material is a woven fabric.

85. The method of claim 76 where in said fabric or other pliable material is a non-woven polymeric fabric.

86. The method of claim 76 wherein said fabric or other pliable material is paper or film.

87. A method for producing a radiation protective article comprising the steps of:

dissolving polymer in a liquid solution, emulsion or suspension of solvent or water;

mixing a relatively lightweight radiation protective material into said liquid solution, emulsion or suspension to create a radiation protective polymeric mixture;

coating said liquid polymeric mixture onto a fabric or other pliable material to make said fabric or other pliable material radiation protective; and, constructing a functional article from said radiation protective fabric or other pliable material.

* * * * *